US006317105B1

(12) United States Patent
Eo et al.

(10) Patent No.: US 6,317,105 B1
(45) Date of Patent: Nov. 13, 2001

(54) METHOD FOR RESETTING PLASMA DISPLAY PANEL

(75) Inventors: Yoon-phil Eo, Chunan; Kyoung-ho Kang, Asan; Jeong-duk Ryeom, Chunan, all of (KR)

(73) Assignee: Samsung Display Devices, Ltd., Kyungki-DO (KR)

( * ) Notice: Subject to any disclaimer, the term of this patent is extended or adjusted under 35 U.S.C. 154(b) by 0 days.

(21) Appl. No.: 09/361,408

(22) Filed: Jul. 27, 1999

(30) Foreign Application Priority Data

Jul. 29, 1998 (KR) ..... 98-30679

(51) Int. Cl.[7] ..... G09G 3/28
(52) U.S. Cl. ..... 345/68; 345/60
(58) Field of Search ..... 315/169.1, 169.3, 315/169.4, 169.2; 345/66, 67, 68, 60, 41

(56) References Cited

U.S. PATENT DOCUMENTS

Re. 37,083 * 3/2001 Kanazawa ..... 315/169.4
5,446,344 * 8/1995 Kanazawa ..... 315/169.4
5,854,540 * 12/1998 Matsumoto et al. ..... 315/169.1
6,140,984 * 10/2000 Kanazawa et al. ..... 345/67

* cited by examiner

*Primary Examiner*—Steven Saras
*Assistant Examiner*—Uchendu O. Anyaso
(74) *Attorney, Agent, or Firm*—Lowe Hauptman Gilman & Berner, LLP

(57) ABSTRACT

A resetting method for erasing wall charges remaining around a first display electrode and a second display electrode in a second sub-field following after applying a final sustain discharge voltage between the first display electrode and the second display electrode in a first sub-field on a plasma display panel, including the steps of applying a first voltage higher than and having the opposite polarity to the final sustain discharge voltage between the first display electrode and the second display electrode, to cause a first discharge and accumulation of wall charges, and gradually decreasing the level of the first voltage until the first display electrode and the second display electrode are made to be at the same potential, to cause a second discharge weaker than and longer than the first discharge by the accumulated wall charges, and erasing the wall charges.

9 Claims, 6 Drawing Sheets

METHOD FOR RESETTING PLASMA DISPLAY PANEL

BACKGROUND OF THE INVENTION

1. Field of the Invention

The present invention relates to a method for resetting a plasma display panel, and more particularly, to a resetting method for erasing wall charges remaining around first display electrodes and second display electrodes in a second sub-field following a first sub-field, after applying a final sustain discharge voltage between the first and second display electrodes in the first sub-field of the plasma display panel.

2. Description of the Related Art

FIG. 1 shows an electrode line pattern of a general plasma display panel, and FIG. 2 is a schematic cross section of a pixel of the pattern shown in FIG. 1. Referring to the drawings, in a general surface-discharge plasma display panel, address electrode lines A1, A2, A3, . . . and Am, a first dielectric layer 21, phosphors 22, scan electrode lines Y1, Y2, . . . . and Yn−1 (231 and 232 in FIG. 2), common electrode lines X, (241 and 242 in FIG. 2), a second dielectric layer 25 and a protective film 26 are provided. The respective scan electrode lines Y1, Y2, . . . and Yn−1 are comprised of a scanning indium tin oxide (ITO) electrode line 231 and a scanning bus electrode line 232, as shown in FIG. 2. Similarly, the common electrode lines X are comprised of a common ITO electrode line 241 and a common bus electrode line 242. A gas for forming plasma is hermetically sealed in a space between the protective film 26 and the first dielectric layer 21.

The address electrode lines A1, A2, A3, . . . and Am are coated on a lower substrate (not shown) as a first substrate in a predetermined pattern. The first dielectric layer 21 is entirely coated over the address electrode lines A1, A2, A3, . . . and Am. The phosphors 22 are coated on the first dielectric layer 21 in a predetermined pattern. In some cases, the first dielectric layer 21 may not be formed. Instead, the phosphors 22 may be coated over the address electrode lines A1, A2, A3, . . . and Am in a predetermined pattern. The scan electrode lines Y1, Y2, . . . , Yn−1, 231 and 232 and the common electrode lines X, 241 and 242 are arranged on an upper substrate (not shown) as a second substrate to be orthogonal to the address electrode lines A1, A2, A3, . . . and Am in a predetermined pattern. The respective intersections define corresponding pixels. The second dielectric layer 25 is entirely coated over the scan electrode lines Y1, Y2, . . . , Yn−1, 231 and 232 and the common electrode lines X, 241 and 242. The protective film 26 for protecting the panel against a strong electrical field is entirely coated over the second dielectric layer 25.

The driving method generally adopted to the plasma display panel described above is an address/display separation driving method in which a reset step, an address step and a sustain discharge step are sequentially performed in a unit sub-field. In the reset step, wall charges remaining in the previous sub-field are erased. In the address step, the wall charges are formed in a selected pixel area. Also, in the sustain discharge step, light is produced at the pixels at which the wall charges are formed in the address step. In other words, if alternating pulses of a relatively high voltage are applied between the common electrode lines X and the scan electrode lines Y1, Y2, . . . , Yn−1 and Yn, a surface discharge occurs at the pixels at which the wall charges are formed. Here, plasma is formed at the gas layer of the discharge space between the protective film 26 and the first dielectric layer 21 and the phosphors 22 are excited by ultraviolet rays to thus emit light.

For adoption of the address/display separation driving method, conventionally, a first voltage of a high level is applied between the scan electrode lines Y1, Y2, . . . , Yn−1, 231 and 232 and the common electrode lines X, 241 and 242, and the scan electrode lines Y1, Y2, . . . , Yn−1, 231 and 232 and the common electrode lines X, 241 and 242 are made to be at the same electric potential. Accordingly, a first discharge is performed by the first voltage and a second discharge is performed by accumulated wall charges so that the wall charges are erased.

According to the conventional resetting method, first and second discharges occur strongly at all pixels. Therefore, light of a high intensity is produced at unselected pixels of the current sub-field, which deteriorates the contrast of the plasma display panel.

SUMMARY OF THE INVENTION

To solve the above problem, it is an objective of the present invention to provide a resetting method by which wall charges can be erased by a weaker discharge during an address/display separation driving operation of a plasma display panel.

Accordingly, to achieve the above objective, there is provided a resetting method for erasing wall charges remaining around a first display electrode and a second display electrode in a second sub-field following after applying a final sustain discharge voltage between the first display electrode and the second display electrode in a first sub-field on a plasma display panel, including the steps of applying a first voltage higher than and having the opposite polarity to the final sustain discharge voltage between the first display electrode and the second display electrode, to cause a first discharge and accumulation of wall charges, and gradually decreasing the level of the first voltage until the first display electrode and the second display electrode are made to be at the same potential, to cause a second discharge weaker than and longer than the first discharge by the accumulated wall charges, and erasing the wall charges.

Accordingly, in the erase step, the level of the first voltage is decreased continuously. To this end, the erase step includes the steps of allowing either the first or second display electrode to be connected to a ground port through a resistance element, and allowing some of the current generated by the second discharge to flow to the ground port through the resistance element while making the potentials of the first and second display electrodes immediately become the same to each other.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENT

Figure 3:
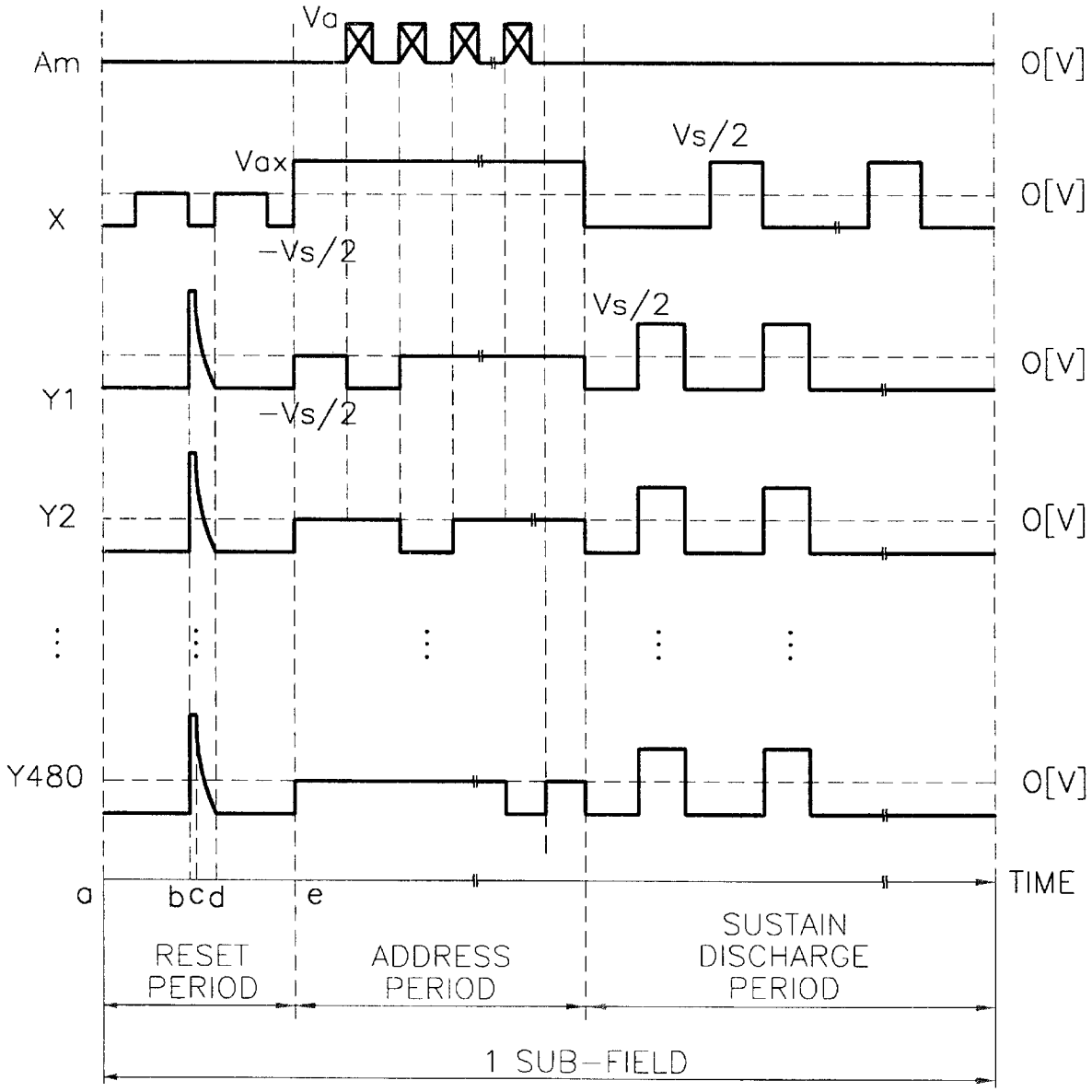
FIG. 3 is a diagram showing voltage waveforms applied to electrode lines according to a plasma display panel resetting method based on an embodiment of the present invention.

FIG. 3 is a diagram showing voltage waveforms applied to electrode lines according to a plasma display panel resetting method based on an embodiment of the present invention.

Figure 1:
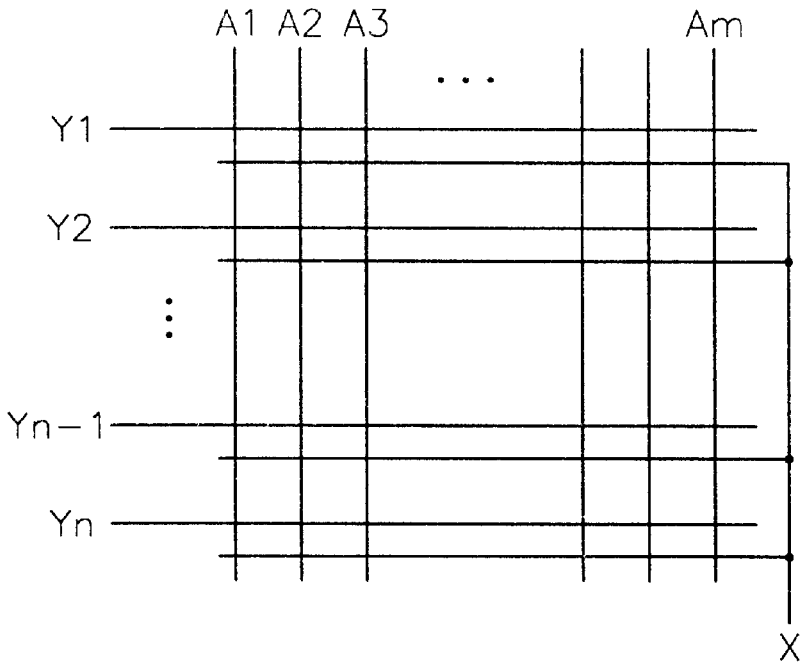
FIG. 1 shows an electrode line pattern of a general plasma display panel.
Figure 2:
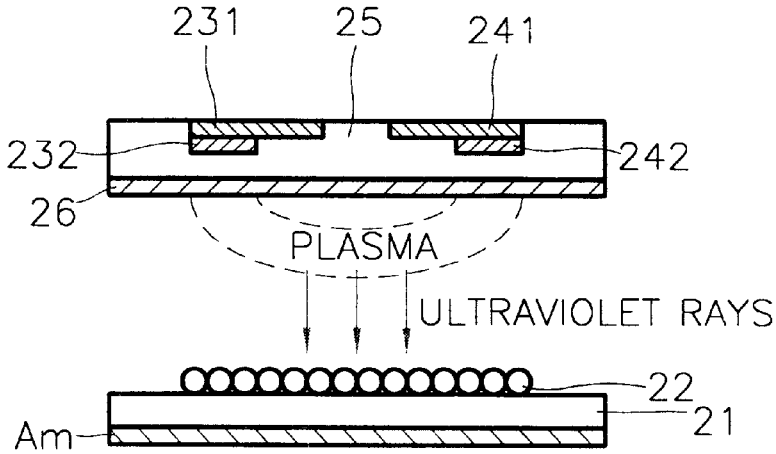
FIG. 2 is a schematic cross section of a pixel of the pattern shown in FIG. 1.
Figure 4:
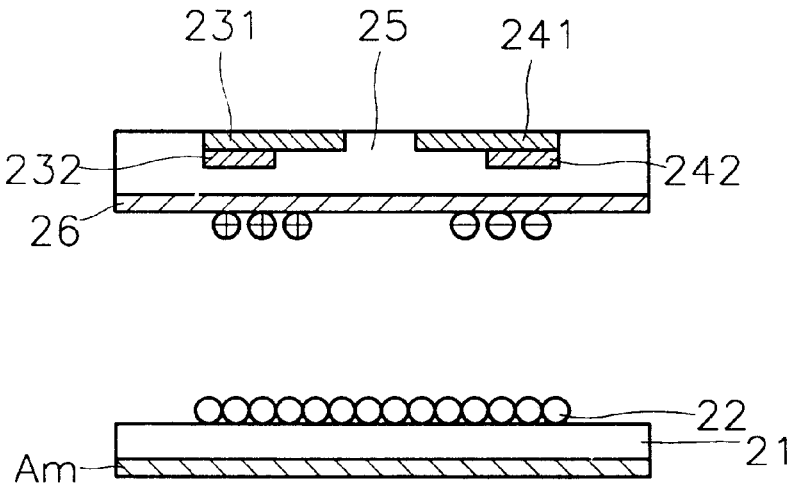
FIG. 4 is a cross-sectional view illustrating the state of pixels directly after a sustain discharge period shown in FIG. 3.

Referring to FIG. 3, according to a plasma display panel resetting method based on an embodiment of the present invention, after a final sustain discharge voltage Vs is applied between common electrode lines X as first display electrode lines and scan electrode lines Y1, Y2, . . . and Y480 as second display electrode lines in a first sub-field on the plasma display panel, wall charges remaining around the common electrode lines X and the scan electrode lines Y1, Y2, . . . and Y480 are erased in a second sub-field following the first sub-field. In FIG. 3, reference mark Va denotes a voltage applied to address electrode lines Am selected in the address period, and Vax denotes a voltage applied to common electrode lines X during the address period. Referring to FIG. 4, at a termination timing of the first sub-field, positive wall charges remain on the area of selected pixels of the scan electrode lines Y1, Y2, . . . , Y480, 231 and 232 and negative wall charges remain on the area of selected pixels of the common electrode lines X, 241 and 242. In FIG. 4, the same reference numerals as those of FIG. 2 designate the same elements.

Figure 5:
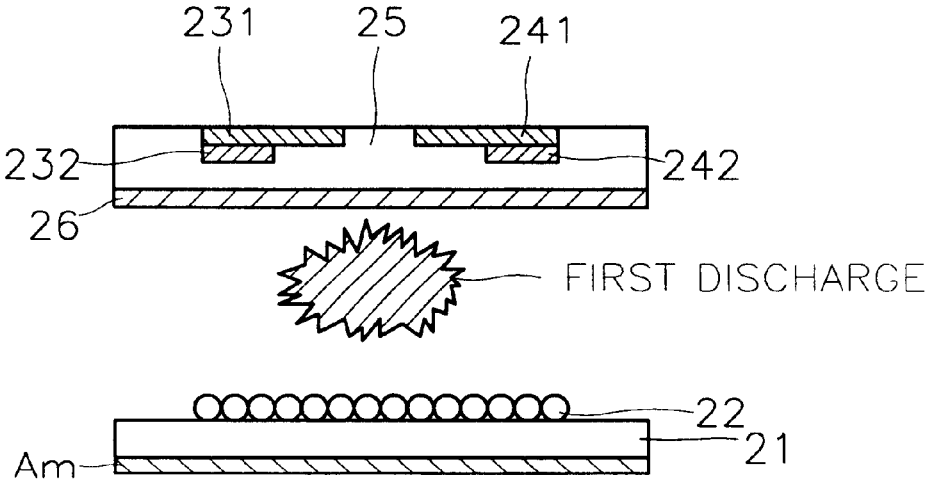
FIG. 5 is a cross-sectional view illustrating the state of pixels when a first discharge occurs at a timing b of FIG. 3.
Figure 6:
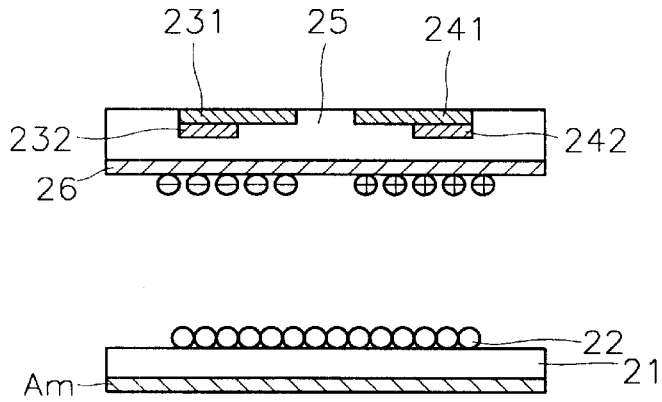
FIG. 6 is a cross-sectional view illustrating the state of pixels at which wall charges are accumulated at a timing c of FIG. 3;.

Next, at a timing b of a reset period a–e, a first voltage, Vs+Vw, which is higher than and has an opposite polarity to the final sustain discharge voltage Vs, is applied between the common electrode lines X, 241 and 242 and the scan electrode lines Y1, Y2, . . . , Y480, 231 and 232, so that a first discharge occurs (see FIG. 5). Accordingly, at a timing c of the reset period a–e, negative wall charges are accumulated in the area of all pixels of the scan electrode lines Y1, Y2, . . . , Y480, 231 and 232. Also, positive wall charges are accumulated in the area of all pixels of the common electrode lines X, 241 and 242 (see FIG. 6). In FIGS. 5 and 6, the same reference numerals as those of FIG. 2 designate the same elements.

Figure 7:
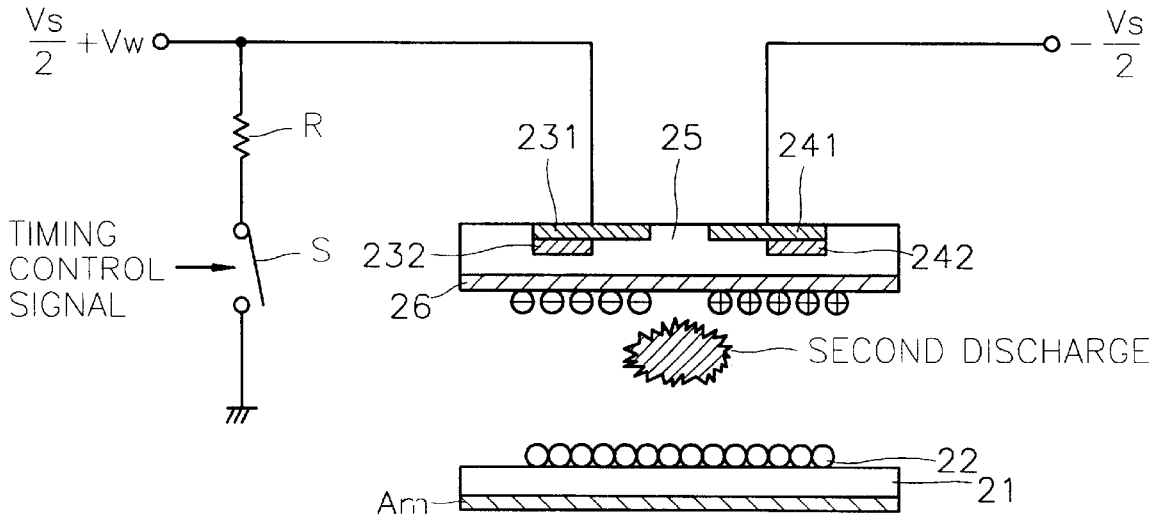
FIG. 7 is a cross-sectional view illustrating the state of pixels when a second discharge occurs during a time period c–d of FIG. 3.
Figure 8:
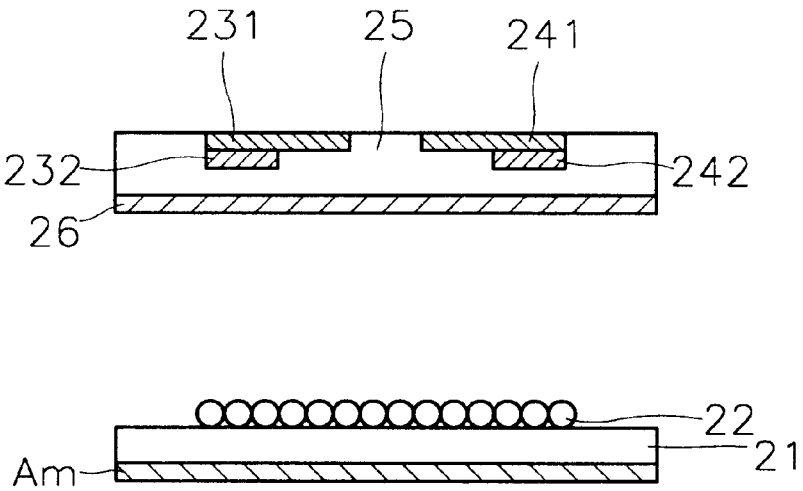
FIG. 8 is a cross-sectional view illustrating the state of pixels at which wall charges are erased at a timing d of FIG. 3.

For a time period c–d of the reset period a–e, the level of the first voltage Vs+Vw is continuously decreased until the scan electrode lines Y1, Y2, . . . , Yn−1, 231 and 232 and the common electrode lines X, 241 and 242 are made to be at the same electric potential, that is, an electric potential corresponding to −2Ns, so that a second discharge weaker than and longer than the first discharge occurs by the accumulated wall charges (see FIG. 7), thereby erasing the wall charges (see FIG. 8). In FIGS. 7 and 8, the same reference numerals as those of FIG. 2 designate the same elements. Referring to FIG. 7, during a time period c–d of the reset period a–e, in order to decrease continuously the level of the first voltage Vs+Vw, a switch element S is turned on to allow the scan electrode lines Y1, Y2, . . . and Y480 to be connected to a ground port through a resistance element R. Also, if a voltage applied to the scan electrode lines Y1, Y2, . . . and Y480 is made to be equal to that applied to the common electrode lines X, 241 and 242, that is, −2Ns, at a timing c, some of the current generated by the second discharge flows to the ground port through the resistance element R during a time period c–d. Accordingly, the effect of continuously decreasing the level of the first voltage Vs+Vw can be achieved, thereby erasing the wall charges by a weaker discharge.

Figure 9:
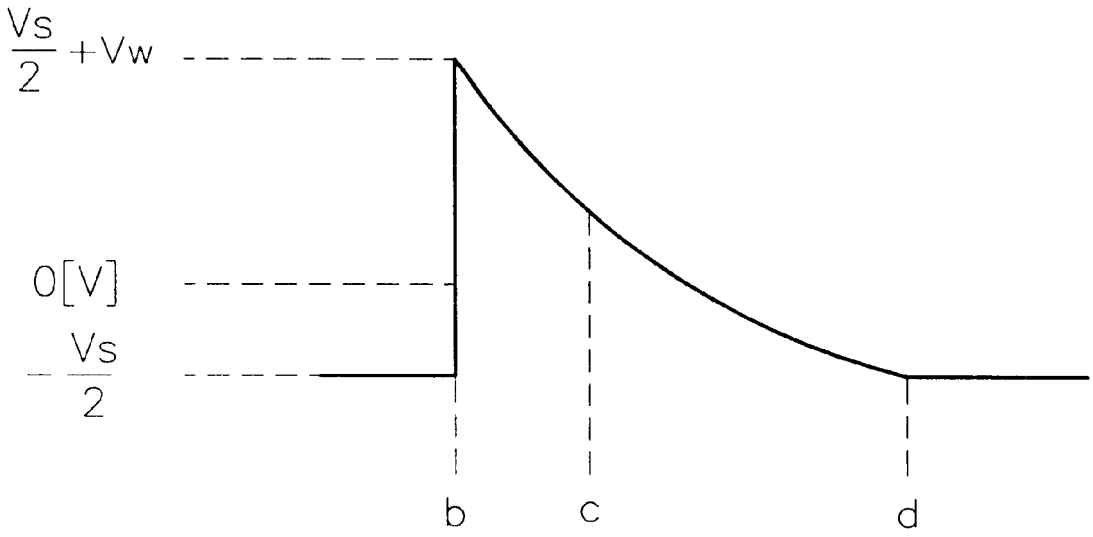
FIGS. 9, 10 and 11 are diagrams showing another voltage waveforms applied to scan electrode lines during a time period b–d of FIG. 3.
Figure 10:
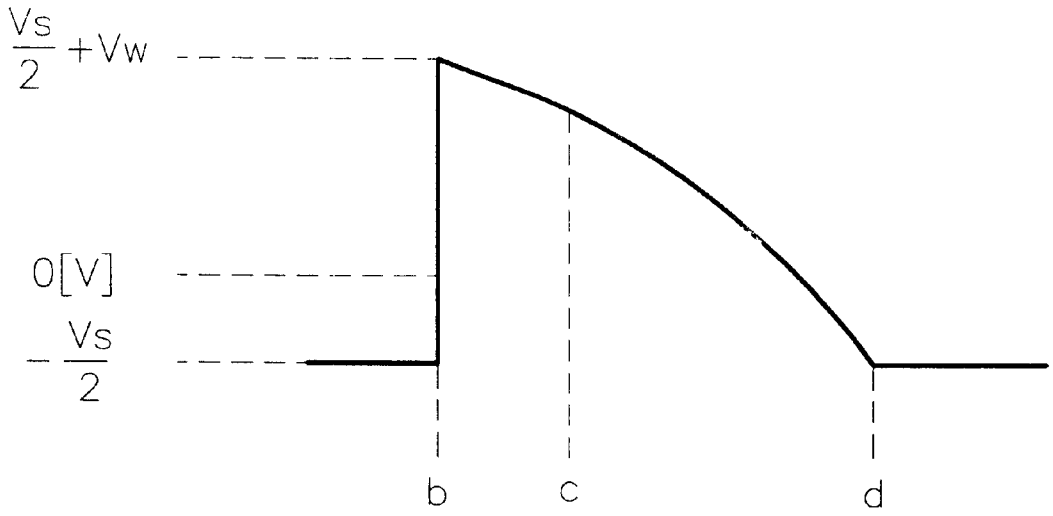
Figure 11:
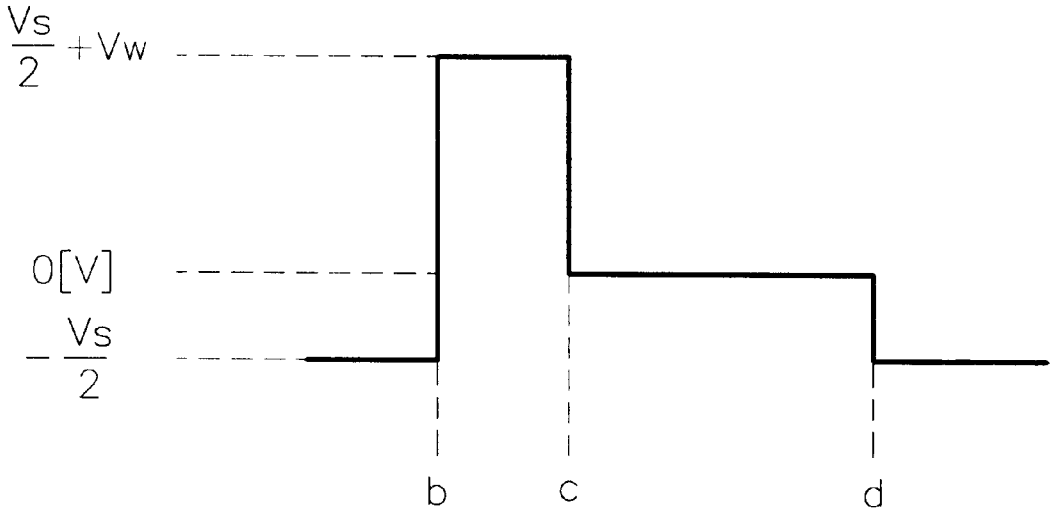

FIGS. 9, 10 and 11 are diagrams showing another voltage waveforms applied to scan electrode lines Y1, Y2, . . . , Y480, 231 and 232 during a time period b–d of FIG. 3. In the waveforms shown in FIGS. 9 and 10, the time period during which a voltage is maintained at a constant level (the time period b–c in FIG. 3) is extremely shortened. In the waveform shown in FIG. 11, the level of the first voltage Vs+Vw is lowered stepwise. The stepped waveform can be attained by a switching operation of a driver, without using the resistance element R and the switch element S shown in FIG. 7.

As described above, according to a plasma display panel resetting method based on an embodiment of the present invention, wall charges are erased by a relatively weak discharge. Thus, light having a low intensity is produced at pixels unselected in the current sub-field, which increases the contrast of the plasma display panel.

Although the invention has been described with respect to a preferred embodiment, it is not to be so limited as changes and modifications can be made which are within the full intended scope of the invention as defined by the appended claims.

What is claimed is:

1. A resetting method for erasing remaining wall charges around a first display electrode and a second display electrode in a subsequent sub-field after applying a final sustain discharge voltage between the first display electrode and the second display electrode in a previous sub-field in a plasma display panel, said method comprising the steps of:

a) applying a reset voltage higher than and having the opposite polarity to the final sustain discharge voltage between the first display electrode and the second display electrode, to cause a first discharge by the remaining wall charges, and accumulation of wall charges; and b) gradually decreasing the level of the reset voltage until potentials of the first display electrode and the second display electrode are equal and longer than the first discharge, by the accumulated wall charges, thereby erasing the remaining and accumulated wall charges.

2. The resetting method according to claim 1, wherein in said step b), the level of the reset voltage is decreased continuously.

3. The resetting method according to claim 2, wherein said step b) comprises the steps of:

connecting one of the first and second display electrodes to ground through a resistance element; and partially conducting a current generated by the second discharge to ground through the resistance element while immediately equalizing the potentials of the first and second display electrodes.

4. A resetting method for erasing remaining wall charges around a first display electrode and a second display electrode in a subsequent sub-field after applying a final sustain discharge voltage between the first display electrode and the second display electrode in a previous sub-field in a plasma display panel, said method comprising the steps of:

a) applying a reset voltage higher than and having the opposite polarity to the final sustain discharge voltage between the first display electrode and the second display electrode, to cause a first discharge by the remaining wall charges, and accumulation of wall charges; and b) decreasing stepwise the level of the reset voltage until potentials of the first display electrode and the second display electrode are equal, to cause a second discharge, weaker and longer than the first discharge, by the accumulated wall charges, thereby erasing the remaining and accumulated wall charges.

5. The resetting method according to claim 1, wherein the level of the reset voltage is decreased monotoncally.

6. The resetting method according to claim 1, wherein the potentials of the first and second electrodes are made equal immediately before a subsequent addressing step begins.

7. The resetting method according to claim 1, wherein the level of the reset voltage is held at an initial value before said decreasing.

8. The resetting method according to claim 1, wherein the first and second electrodes are common and scanning electrodes, respectively.

9. The resetting method according to claim 1, wherein the potentials of the first and second electrodes are switched immediately from the final sustain discharge voltage to the reset voltage.

* * * * *